US009484624B2

(12) United States Patent
Perricone et al.

(10) Patent No.: US 9,484,624 B2
(45) Date of Patent: Nov. 1, 2016

(54) REFLECTION CONTROLLER

(71) Applicants: Nicholas Perricone, Madison, CT (US); Charles Cox, Carlisle, MA (US); Gary Betts, Escondido, CA (US); Harold V. Roussell, Burlington, MA (US)

(72) Inventors: Nicholas Perricone, Madison, CT (US); Charles Cox, Carlisle, MA (US); Gary Betts, Escondido, CA (US); Harold V. Roussell, Burlington, MA (US)

(73) Assignee: Perriquest Defense Research Enterprises, LLC, Meriden, CT (US)

( * ) Notice: Subject to any disclaimer, the term of this patent is extended or adjusted under 35 U.S.C. 154(b) by 172 days.

(21) Appl. No.: 14/158,041

(22) Filed: Jan. 17, 2014

(65) Prior Publication Data

US 2014/0203997 A1 Jul. 24, 2014

Related U.S. Application Data

(60) Provisional application No. 61/754,520, filed on Jan. 18, 2013, provisional application No. 61/781,962, filed on Mar. 14, 2013.

(51) Int. Cl.

| | |
|---|---|
| ***H01Q 15/14*** | (2006.01) |
| ***H01Q 1/28*** | (2006.01) |
| ***H01Q 1/34*** | (2006.01) |
| ***H01Q 15/00*** | (2006.01) |

(52) U.S. Cl.

CPC ..... *H01Q 1/28* (2013.01); *H01Q 1/34* (2013.01); *H01Q 15/0026* (2013.01); *H01Q 15/142* (2013.01)

(58) Field of Classification Search

CPC ..... H01Q 15/14

USPC ..... 343/912

See application file for complete search history.

(56) References Cited

U.S. PATENT DOCUMENTS

| | | | | |
|---|---|---|---|---|
| 6,218,978 | B1 | 4/2001 | Simpkin et al. | |
| 2010/0085237 | A1* | 4/2010 | Cornic | G01S 13/913 342/33 |
| 2011/0210906 | A1* | 9/2011 | Maruyama | H01Q 15/14 343/912 |

OTHER PUBLICATIONS

Natarajan, et al., A Compact Frequency Selective Surface With Stable Response for WLAN Applications, IEEE Antennas and Wireless Propagation Letters, 2013, pp. 718-720, vol. 12.

Seman, et al., Design of a Salisbury Screen Absorber Using Frequency Selective Surfaces to Improve Bandwidth and Angular Stability Performance, IET Micow, Antennas Propag., 2011, pp. 149-156, vol. 5, Iss. 2, The Institute of Engineering and Technology, 2011.

Alkayyali, et al., Convoluted Frequency Selective Surface Wallpaper to Block the Industrial, Scientific, and Medical Radio Bands Inside Buildings, American Academic & Scholarly Research Journal, Apr. 2013, vol. 5, No. 3.

(Continued)

*Primary Examiner* — Sue A Purvis
*Assistant Examiner* — Andrea Lindgren Baltzell
(74) *Attorney, Agent, or Firm* — Kurt Rauschenbach; Rauschenbach Patent Law Group, LLC

(57) ABSTRACT

A reflection controller for modifying electromagnetic reflections from a surface includes a conducting patch being positioned proximate to an electromagnetically reflecting surface. The floating conducting patch includes an electrical conductor at a floating potential positioned on a dielectric substrate where at least one of a dielectric thickness, dielectric constant, or the dimensions of the electrical conductor are chosen to reduces retro-reflection of incident radiation.

25 Claims, 12 Drawing Sheets

(56) References Cited

OTHER PUBLICATIONS http://we-make-money-not-art.com/archives/2004/07/frequency-selective-wallpaper-php#.VlbrbEog IV, retrieved May 28, 2015.
Cukrov, Claudia, Anti-WiFi Wallpaper Prevents People From Stealing Your Signal, Retail, May 2012. www.psfk.com/2012/05/anti-wifi-wallpaper.html, retrieved May 28, 2015.
Smith, Olivia, Signal-blocking wallpaper stops Wi-Fi Stealing(and comes in a snowflake pattern!), CNN, Jul. 18, 2012. http://whatsnext.blogs.cnn.com/2012/07/18/signal-blocking-wallpaper-stops-wi-fi-stealing-and-comes-in-a-snowflake-pattern/, Retrieved, May 28, 2015.
Chen, et al., Bandwidth Enhancement of a U-Slot Patch Antenna Using Dual-Band Frequency-Selective Surface With Double Rectangular Ring Elements, Microwave and Optical Technology Letters, Jul. 7, 2011, pp. 1547-1553, vol. 53, No. 7.
Ray, et al., A Dual Tuned Complementary Structure Frequency Selective Surface for WLAN Applications, Journal of Microwaves, Optoelectronics and Electomagnetic Applications, Jun. 2012, pp. 144-153, vol. 11, No. 1.
Ramaccia, et al., A New Accurate Model of High-Impedance Surfaces Consisting of Circular Patches, Progress in Electromagnetics Research M, 2011, pp. 1-17, vol. 21.
Liu, et al., Design and Analysis of Broadband Microwave Absorber Utilizing FSS Screen Constructed With Circular Fractal Configurations, Microwave and Optical Technology Letters, Mar. 2006, pp. 449-453, vol. 48, No. 3.
Jang, et al., Manufacture and Characterization of Stealth Wind Turbine Blade With Periodic Pattern Surface for Reducing Radar Interference, 2013, 6 pages, Elsevier Ltd.
Samaddar, et al., Prediction of Resonant Frequency of a Circular Patch Frequency Selective Structure Using Artificial Neural Network, Apr. 2014, pp. 397-403, Indian J. Phys.
Chen, Transmission of Microwave Through Perforated Flat Plates of Finite Thickness, Jan. 1973, pp. 1-6, vol. MTT-21, No. 1, IEEE Transactions on Microwave Theory and Techniques.
Sung, et al., A Frequency-Selective Wall for Interference Reduction in Wireless Indoor Environments, IEEE Antennas and Propagation Magazine, Oct. 2006, pp. 29-36, vol. 48, No. 5, IEEE.
Kiani, et al., Cross-Dipole Bandpass Frequency Selective Surface for Energy-Saving Glass Used in Buildings, Feb. 2011, pp. 520-525, vol. 59, No. 2, IEEE.
Sun, et al., Design of Broadband Microwave Absorber Utilizing FSS Screen Constructed With Coupling Configurations, Appl. Phys A., 2012,pp. 1-4.
Danoon, et al., Modeling Methodology for Computing the Radar Cross Section and Doppler Signature of Wind Farms, IEEE Transactions on Antennas and Propagation, Oct. 2013, pp. 5166-5174, vol. 61, No. 10, IEEE.
Spectral-Domain Analysis of Circular Patch Frequency Selective Surfaces, IEEE Transactions on Antennas and Propagation, May 1984, pp. 533-536, vol. AP-32, No. 5, IEEE.

* cited by examiner

REFLECTION CONTROLLER

CROSS-REFERENCE TO RELATED APPLICATIONS

This application claims priority to both U.S. Provisional Patent Application Ser. No. 61/754,520, entitled "Antenna Reflector Control," filed on Jan. 18, 2013 and U.S. Provisional Patent Application Ser. No. 61/781,962, entitled "Reflection Controller," filed on Mar. 14, 2013. The entire specifications of U.S. Provisional Patent Application Ser. No. 61/754,520 and U.S. Provisional Patent Application Ser. No. 61/781,962 are herein incorporated by reference.

The section headings used herein are for organizational purposes only and should not to be construed as limiting the subject matter described in the present application in any way.

INTRODUCTION

The present teaching relates to passive methods and apparatus for controlling the reflection of electromagnetic (EM) energy from the surface of an object. The term "passive" as used herein refers to methods where the electromagnetic signal being reflected is not amplified. The term "object" as used herein refers to anything that reflects any portion of an electromagnetic signal. This term applies to anything that reflects even a very small fraction of the incident electromagnetic signal. For example, an object can be any type of platform, such as a vehicle like an aircraft, ship or a ground vehicle. An object can also be a person to be located.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1A:
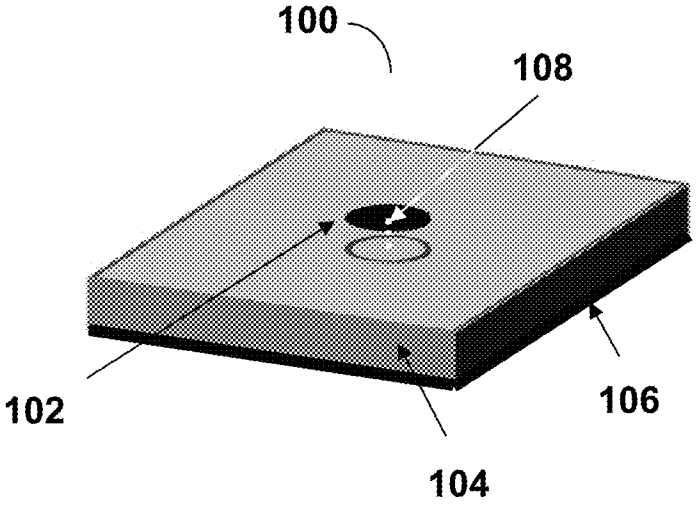
FIG. 1A illustrates a perspective view of a single, prior art patch antenna with connection to a termination made through the substrate.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications, and equivalents, as will be appreciated by those of skill in the art. Those of ordinary skill in the art, having access to the teaching herein, will recognize additional implementations, modifications, and embodiments, as well as other fields of use, which are within the scope of the present disclosure as described herein.

The present teaching relates to methods and apparatus for controlling the reflection of electromagnetic radiation. In general, there are two ways of reducing reflections of electromagnetic radiation from a surface. A first way of reducing reflections of electromagnetic radiation is to absorb a portion of the incident electromagnetic wave so that there is less energy available for reflection. See, for example, U.S. Patent Application Ser. No. 61/754,520 entitled "Antenna Reflection Control," which is assigned to the present assignee, for a description of how antennas can be used to absorb a portion of the incident electromagnetic waves.

A second way of reducing reflections of electromagnetic radiation is to reduce the retro-reflected power. Retro-reflection of electromagnetic radiation is when the electromagnetic radiation is reflected back to its source. That is, the electromagnetic wave front is reflected back along a vector that is parallel to, but opposite in direction, from the electromagnetic wave's source. This is in contrast to specular reflection, where the electromagnetic wave that is incident on a surface at an angle $\theta$ will be reflected by the surface at an angle $-\theta$, where both these angles are measured relative to the surface normal. Hence retro-reflection from a flat surface occurs only when $\theta=0$.

One aspect of the present teaching is to provide antenna reflection control by reducing or minimizing the retro-reflected power from an incident electromagnetic wave. Reducing or minimizing the retro-reflected power, without absorbing a portion of the incident wave so that there is less energy available for reflection, will necessarily mean that reflected power will increase in directions other than the retro-reflection direction, because of conservation of energy.

One specific application of reflection control where reducing or minimizing the retro-reflected power of an electromagnetic wave is sufficient, is for reducing or changing a radar signature of an object. Virtually all radars in operation today use a mono-static configuration, which is a configuration where the receiving antenna is co-located with the transmitting antenna. In most modern radars, the same antenna is used for both transmitting and receiving radar signals. In these radar systems, at least a portion of the radar wave that is incident on the object must be retro-reflected back in the direction from which the incident wave came. However, an increase in reflected power in direction(s) other than the retro-reflected direction will not be detected by a monostatic radar, because monostatic radars cannot detect the power reflected in any direction other than the retro-reflection direction.

An antenna is defined as a device for transitioning between an unguided wave, i.e. a wave in free space, and a guided wave, i.e. a voltage or a current in a circuit external to the antenna. This definition implies that an antenna must contain some means for making an electrical connection between the antenna and the external circuit. The conductive patch element of the present teaching is at a floating potential, and there is no means for providing a connection between the floating patch and an external circuit. Hence, the floating conductive patch is not an antenna as one skilled in the art would understand an antenna. Therefore, we use the term retro-reflective control element to refer to a basic element of controlling reflection, according to the present teaching.

It should be noted that although some aspects of the present teaching are described in connection with conductors receiving radio waves, it should be understood that the methods and apparatus of the present teachings are not limited to radio waves. The present teaching can be practiced with receiving a wide range of frequencies in the electromagnetic spectrum.

FIG. 1A illustrates a perspective view of a single, prior art patch antenna with connection to a termination made through the substrate. The patch antenna 100 shown in FIG. 1A includes a circular conductive element 102 that is centered on a dielectric substrate 104. The patch antenna 100 includes a conductive base plate 106 that is formed of an electrically conductive material, such as copper or aluminum. A small diameter aperture 108 is formed in the dielectric substrate 104 and a wire is fed through the aperture 108 to the rear surface where an RF connector is attached to terminate the antenna.

Figure 1B:
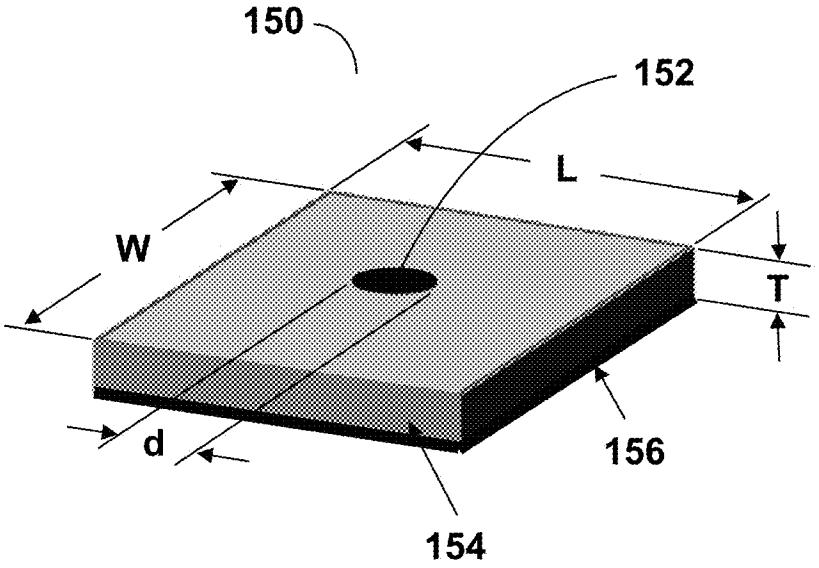
FIG. 1B illustrates a perspective view of a single retro-reflective control element operating at a floating potential without a termination that, according to the present teaching, implements retro-reflection control.

FIG. 1B illustrates a perspective view of a single retro-reflective control element operating at a floating potential, without a termination according to the present teaching. In one embodiment, the retro-reflecting control element is a circular conductive patch that is similar to a patch antenna, but with no electrical termination. However, it should be understood that the invention is not limited to only single conductive patch elements. The term "floating" is referred to herein as being at a floating potential, which can mean that the element is not being electrically connected to a voltage source in a way where a fixed potential is established on the element. Thus, the floating conductive patch described herein does not conform to the generally accepted definition of an antenna, which is why we are referring to it only as a conductive patch.

The retro-reflecting control element 150 shown in FIG. 1B includes a circular conductive element 152 with a diameter d that is centered on a dielectric substrate 154. In other embodiments, the conductive element 152 is not centered on the dielectric substrate 154. The circular conductive element 152 can be formed of a single conductive material, such as copper or aluminum or can be formed of two or more different types of materials in the same or different sections of patch. The circular conductive element 152 is floating and, in this particular embodiment, there is no means for making a connection to the patch, as would be done with a conventional antenna.

The retro-reflecting control element 150 also includes a base plate 156 that is formed of a material, which is at least partially conductive, such as a carbon fiber composite, or a highly conductive material such as copper. In the specific embodiment shown in FIG. 1B, the dielectric substrate 154 is square, with dimensions that are larger than the diameter of the circular conductive element 152. The dielectric substrate has a thickness T and dielectric constant k. In the specific embodiment shown in FIG. 1B, the dielectric substrate is square, with a width, W that is equal to its length L, where the width and the length are significantly greater than the thickness T.

It should be noted that retro-reflecting control elements, according to the present teaching, are not limited to patch shaped structures. It should be understood that the conductive patches of the present teaching are not limited to circular structures, and can be formed in numerous different shapes.

It should also be understood that the conductive patches of the present teaching are not limited to planar structures. Furthermore, retro-reflecting control elements, according to the present teaching, are not limited to particular conductive materials, particular shapes of the conductive element, or to particular shapes of the dielectric substrate.

Figure 2A:
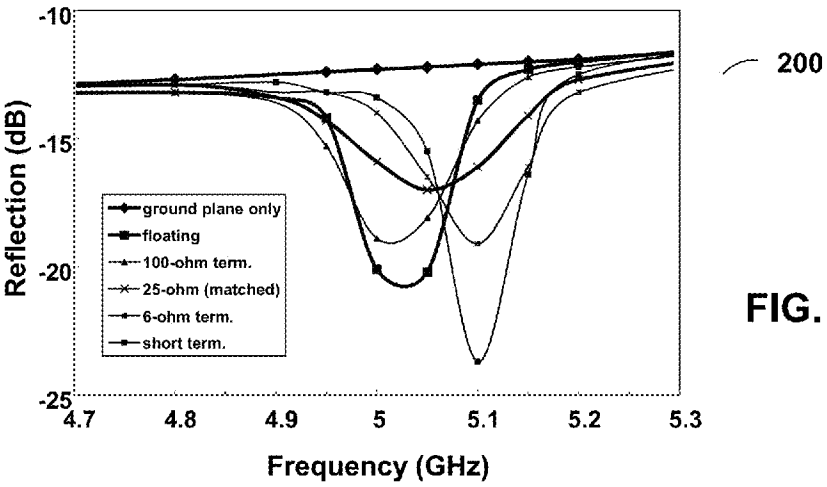
FIG. 2A illustrates plots of simulated reflection at broadside, as a function of frequency, for a flat metal plate and for the patch antenna shown in FIG. 1A with various values of termination impedance.

FIG. 2A illustrates plots 200 of simulated reflection at broadside, as a function of frequency, for a flat metal plate and for the patch antenna shown in FIG. 1A, with various values of termination impedance. The simulations described herein were performed using three-dimensional electromagnetic field simulation software commercially available from Computer Simulation Technology, Inc. To establish a reference level for the effectiveness of retro-reflecting control elements at suppressing an object's reflection, the reflection for a metal plate that is the same size as the base plate of the patch antenna, is shown in FIG. 2A.

Retro-reflection simulations of the patch antenna with various terminations show a significant reduction in retro-reflection relative to the retro-reflection of a flat plate. Simulation data is presented for a shorted termination, a 6 Ohm termination, a 25 Ohm termination, and a 100 Ohm termination. The 25 Ohm termination is a matched termination for this particular antenna. In addition, simulation results are shown for a floating or unterminated patch antenna. The simulation results show that the floating unterminated patch has a relatively high reduction of retro-reflection. In fact, the reduction of retro-reflection of the floating unterminated patch is greater than all the terminations except for the shorted termination, which has a slightly deeper null. However, the simulation results for the shorted termination have a significantly narrower bandwidth, which can make it a less desirable option for some applications. Thus, retro-reflection simulation indicates that a floating patch antenna has surprisingly good reduction of retro-reflection. Therefore, floating patch antennas can be used for reflection control of mono-static radar signals to modify the visibility of objects to such radars, regardless of whether incident energy is absorbed from the radar signal by the antenna. One aspect of the present teaching is the realization that floating patch elements are highly effective in re-directing the reflected energy away from the retro-reflection direction.

Figure 2B:
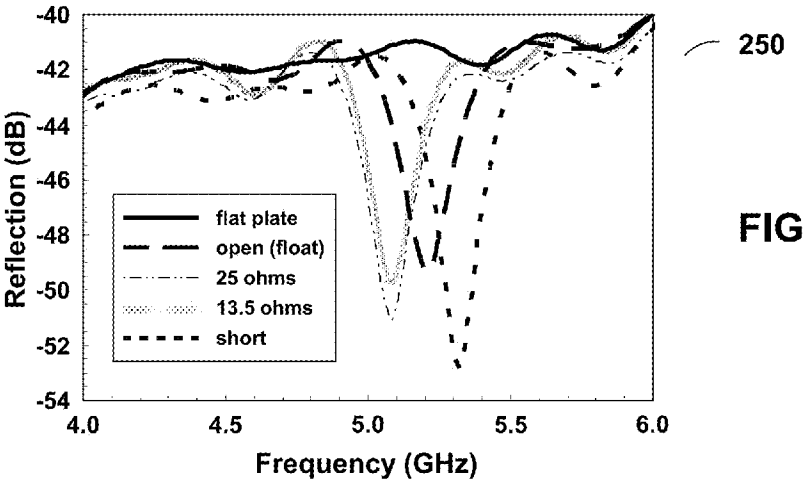
FIG. 2B illustrates experimental results for reflection measured at broadside, as a function of frequency, for a flat metal plate and for the patch antenna shown in FIG. 1A with various values of termination impedance.

FIG. 2B illustrates experimental results for a reflection 250 measured at broadside, as a function of frequency, for a flat metal plate and for the patch antenna shown in FIG. 1A, with various values of termination impedance. The patch antenna of FIG. 1A was mounted in an anechoic chamber. Data are presented for changes in broadside retro-reflection, measured with various termination impedances, attached to the RF connector feeding the patch. Generally, these experimental measurements correspond well with the simulations of the reflection presented in FIG. 2A for similar termination impedances.

Figure 3:
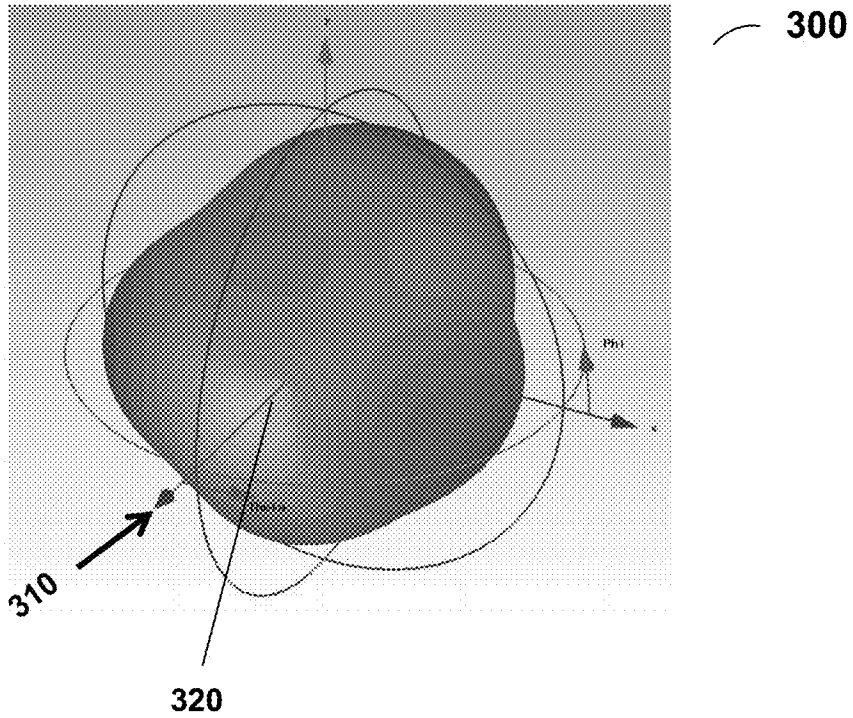
FIG. 3 is a three-dimensional simulation plot of reflection of a plane wave traveling along the positive z-axis towards the origin of the plot for a single retro-reflective control element, comprising a floating conductive patch as described in connection with FIG. 1B.

FIG. 3 is a three-dimensional simulation plot 300 of reflection of a plane wave 310 traveling along the positive z-axis towards the origin of the plot for a single retro-reflective control element, comprising the floating potential conductive patch described in connection with FIG. 1B. The three dimensional plot 300 of reflection clearly indicates that there is a null in the reflected pattern in the direction of the incident wave, directly in the retro-reflection direction 320, which is highly desirable for some applications.

Figures 4A, 4B:
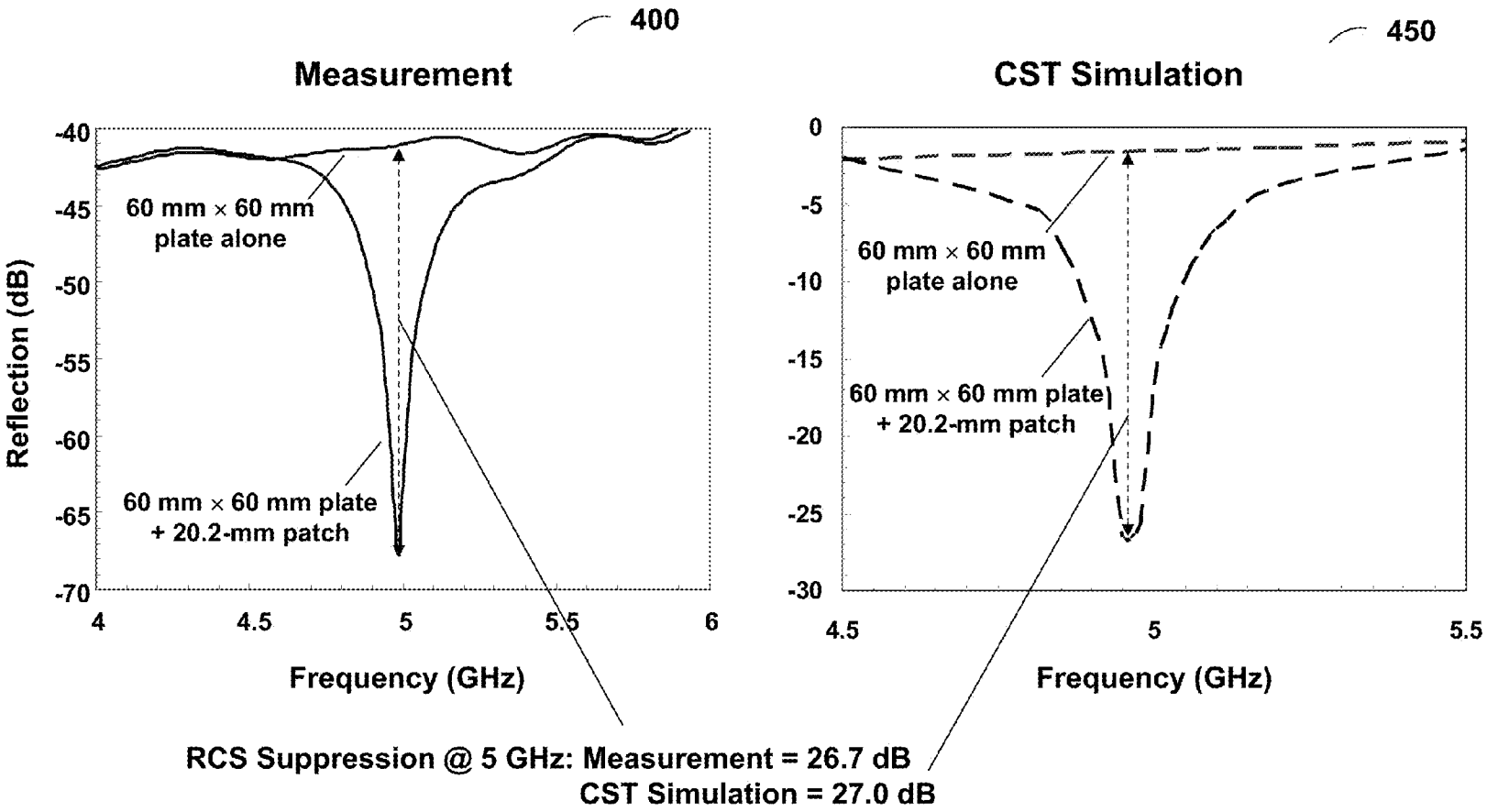
FIG. 4A illustrates plots of experimentally measured reflection in the retro-reflection direction at broadside, as a function of frequency, for the single retro-reflective control element described in connection with FIG. 1B, and for a bare plate with the same dimensions.
FIG. 4B illustrates plots of simulated reflection in the retro-reflection direction at broadside, as a function of frequency, for the single retro-reflective control element, and for a bare plate with the same dimensions described in connection with FIG. 1B.

FIG. 4A illustrates plots 400 of experimentally measured reflection in the retro-reflection direction at broadside, as a function of frequency, for the single retro-reflective control element described in connection with FIG. 1B, and for a bare plate with the same dimensions. The diameter of the floating patch is 20.2 mm and the dimensions of bare metal plate are 60 mm×60 mm. The thickness of the dielectric substrate was 3.175 mm thick. The dielectric constant of the substrate was about 2.2. The data used in the plot 400 was experimentally measured in an anechoic chamber. The data indicate that the single retro-reflective control element provides a very significant decrease in retro-reflection that is about 26.7 dB at a frequency of about 5 GHz.

FIG. 4B illustrates plots 450 of simulated reflection in the retro-reflection direction at broadside, as a function of frequency, for the single retro-reflective control element described in connection with FIG. 1B. The simulations were performed for a floating conductive patch with the same dimensions and dielectric constant as the devices measured, as described in connection with FIG. 4A. The simulation results show that there is a deep null in the retro reflection that corresponds well with the experimental results presented in FIG. 4A, indicating excellent agreement between the modeled and measured results.

One important performance metric of the retro-reflective control elements, according to the present teaching, is the effective area over which the floating antenna shadows or re-directs the incident energy. Various experiments and electromagnetic simulations have been performed to investigate the shadowing area of various geometries and physical characteristics of the retro-reflective control elements.

Figure 5B:
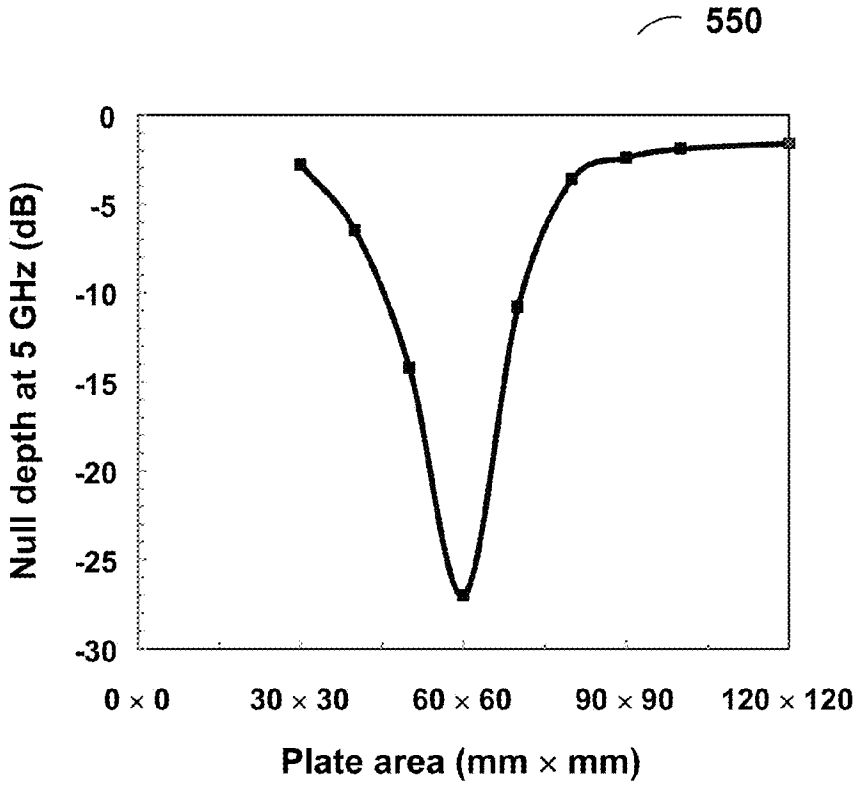
FIG. 5B illustrates a plot of null depth of the retro-reflection from the single retro-reflective control element at broadside as a function of the plate dimensions shown in FIG. 5A.
Figure 5A:
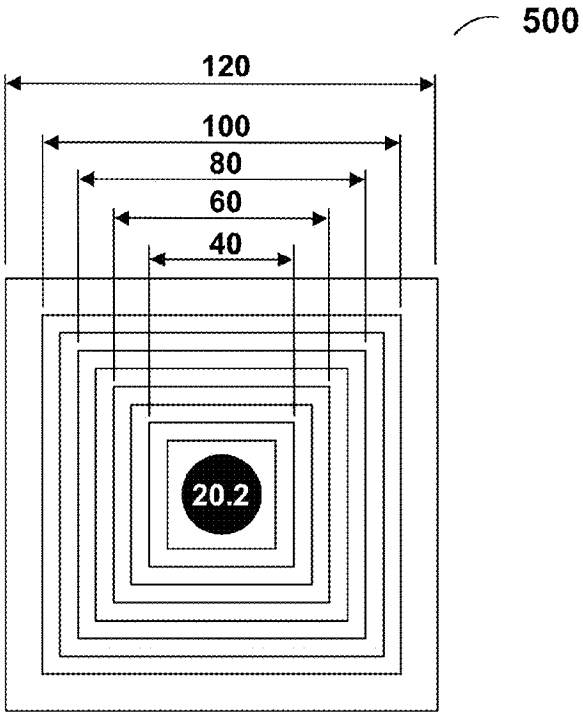
FIG. 5A illustrates a diagram of a single retro-reflective control element comprising a floating circular conductive patch that is centered on a series of square dielectric substrates with metal backing plates of increasing sizes.

FIG. 5A illustrates a diagram of a single retro-reflective control element 500 comprising a floating circular conductive patch element that is centered on a series of square dielectric substrates with metal backing plates of increasing sizes. Retro-reflection suppression of the floating circular conductive patch, having fixed dimensions, was simulated on the series of different types of substrates of various dimensions. The diameter of the circular conductive element was 20.2 mm. The plate dimensions used for the simulation were 40×40 mm, 60×60 mm, 80×80 mm, 100×100 mm, and 120×120 mm.

FIG. 5B illustrates a plot of null depth of the retro-reflection from the single retro-reflective control element at broadside, as a function of the plate dimensions shown in FIG. 5A. Each data point on the plot corresponds to one of the different substrate sizes shown in FIG. 5A. The plot 550 indicates that for plate areas that are either smaller or larger than a certain maximum size, which in this case is about 60×60 mm, the retro-reflective control element becomes significantly less effective at suppressing the retro-reflection. For example, the reduction in the null depth at 30×30 mm, as compared to the null depth at 60×60 mm, is about 24 dB. These results indicate that there exists a maximum effective area, $A_E$, for a given frequency and patch diameter. The data are presented for a frequency of 5 GHz. Thus, one aspect of the present teaching is that individual retro-reflective control elements are effective to shadow certain effective areas from retro-reflection.

Figure 6B:
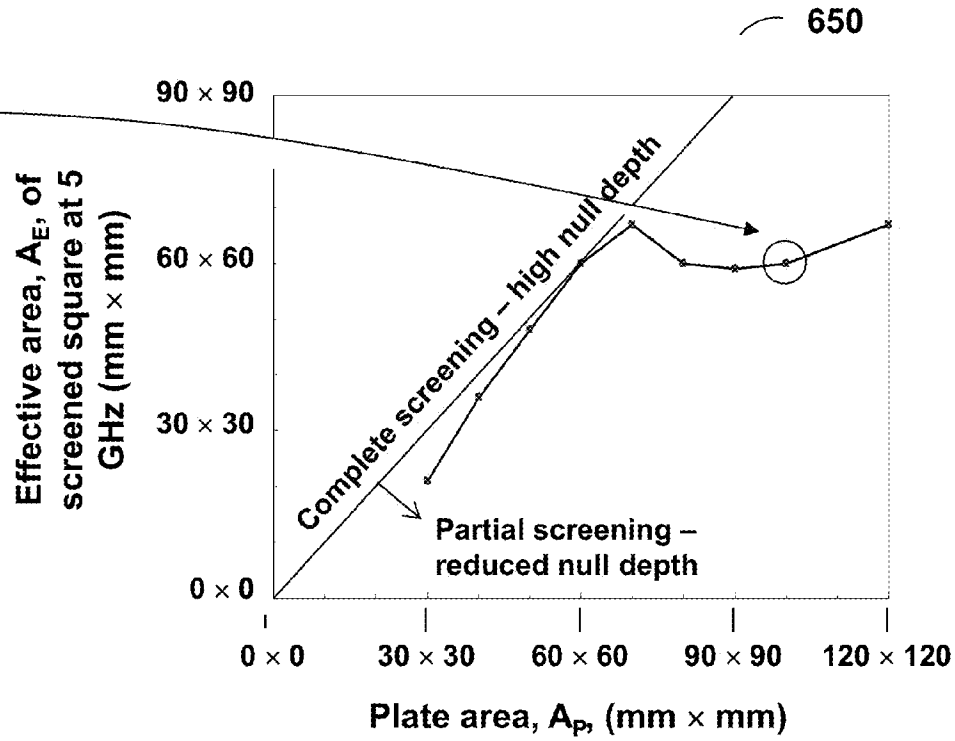
FIG. 6B is a plot of the effective shadow area, $A_E$, at 5 GHz as a function of plate area, $A_P$.
Figure 6A:
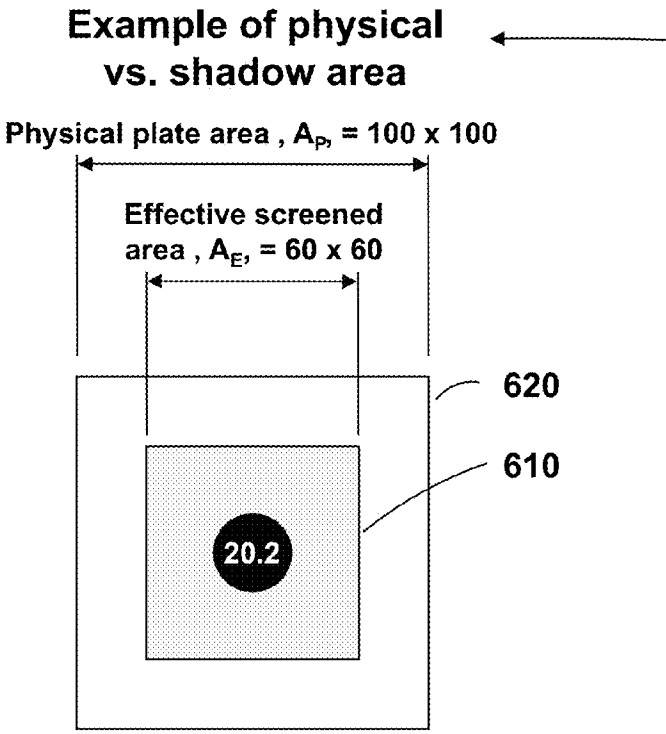
FIG. 6A illustrates a diagram of a retro-reflective control element with an effective shadow area, $A_E$, positioned on a larger plate area of 100×100 mm.

FIG. 6A illustrates a diagram of a retro-reflective control element 600 with an effective shadow area, $A_E$, 610, positioned on a larger plate area of 100×100 mm, 620. In other words, the retro-reflective control element 600 has a physical area of 100×100 mm, but the shadow or effective screening area is 60×60 mm. The effective shadowed area, $A_E$, can be expressed as a function of the physical plate area, $A_P$, with the following equation:

$$A_E = A_P 10^{\frac{\text{Null depth@5 GHz}}{10}}.$$

FIG. 6B is a plot 650 of the effective shadow area, $A_E$, at 5 GHz as a function of plate area, $A_P$, according to the above equation. A diagonal line is plotted to indicate where the shadow area equals the physical area. The plot 650 indicates that for physical areas greater than the maximum $A_E$, which the data in FIG. 5B show for the present example to be 60×60 mm, the shadow area remains essentially constant at 60×60 mm. The data indicate that a retro-reflective control element, whose diameter is roughly half a wavelength at the measurement frequency, which is 5 GHz in this particular example, can effectively shadow a plate area that is approximately one full wavelength in length/width. The result that the shadow area extends well beyond the conducting patch area is a significant unexpected result.

The data also indicate that as the plate area decreases below the maximum shadow area, the retro-reflective control element retains its shadowing ability, as indicated by the fact that the shadow area remains roughly equal to the physical area.

Figure 7:
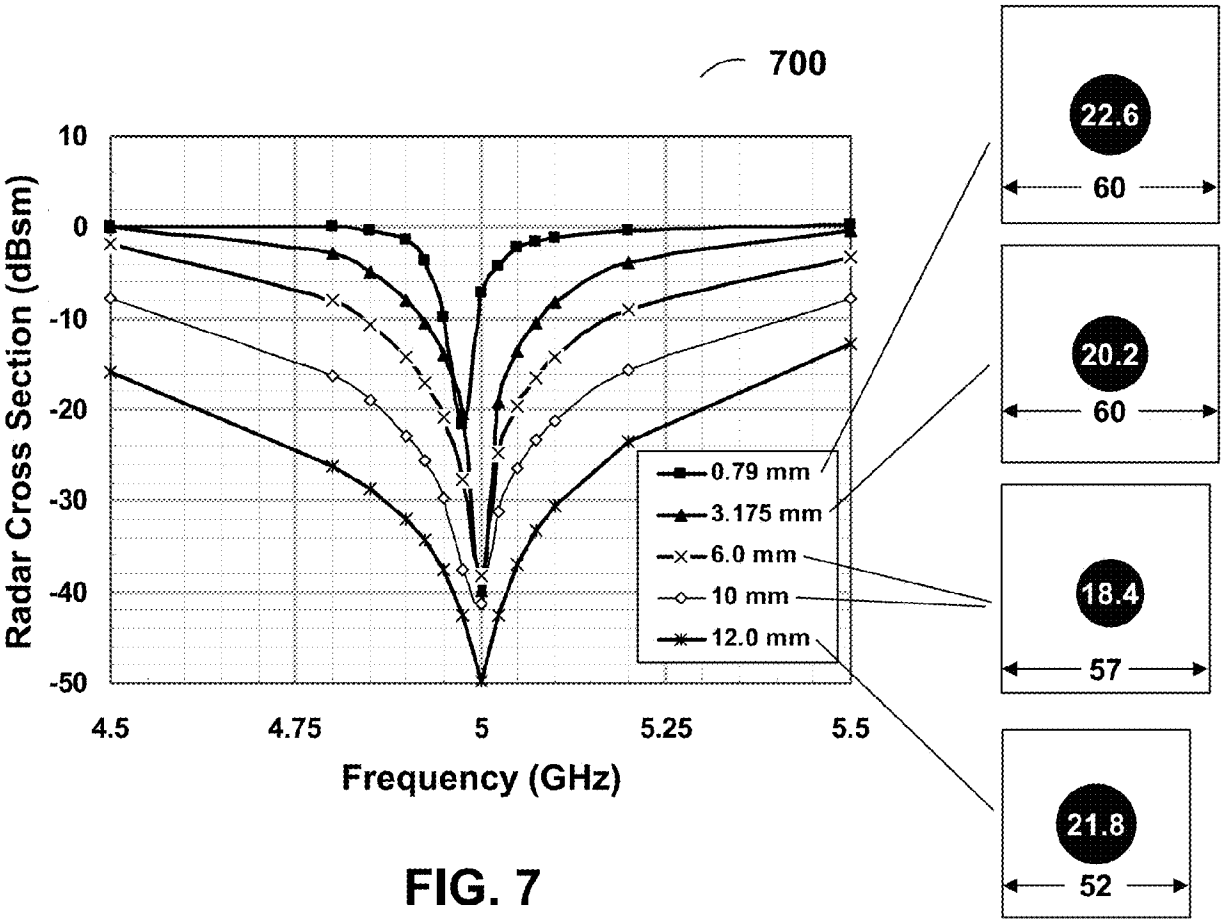
FIG. 7 presents simulation data of radar cross section of a retro-reflective control element according to the present teaching at broadside as a function of frequency for various dielectric substrate thicknesses.

FIG. 7 presents simulation data 700 of radar cross section of a retro-reflective control element according to the present teaching at broadside as a function of frequency for various dielectric substrate thicknesses. The term "radar cross section" (RCS) of an object is well known in the art and is a measure of the radar power that is retro-reflected by the object and thus, is a measure of how detectable an object is with a radar. The simulation data are presented for various dielectric substrate thicknesses and bare metal plates of the same dimension as the substrate. The diameters of the circular conductive elements were scaled to keep the resonant frequency of the retro-reflection null at a constant frequency. The scaling also maintained a constant shadowing area as the diameter of the patch was changed. Data are presented for the following geometries: (1) a 0.79 mm thick substrate with a 22.6 mm diameter circular conductive element and a 60×60 mm substrate; (2) a 3.175 mm thick substrate with a 20.2 mm diameter circular conductive element and a 60×60 mm substrate; (3) a 6.0 mm thick substrate with a 18.4 mm diameter circular conductive element and a 57×57 mm substrate; (4) a 10.0 mm thick substrate with a 18.4 mm diameter circular conductive element and a 57×57 mm substrate; and (5) a 12.0 mm thick substrate with a 21.8 mm diameter circular conductive element and a 52×52 mm substrate. These geometries are summaries on the right side of the figure.

The simulation data 700 presented in FIG. 7 indicate two effects of changing the substrate thickness. First, the data indicate that changing the substrate thickness changes the depth of the null. However, simulations with different densities of data points indicate that equally deep null depths may be achievable for many dielectric thicknesses. Second, the data indicate that there is a significant increase in the frequency bandwidth of the null for a given level of retro-reflection suppression as the thickness of the dielectric substrate increases. For example, for −20 dB suppression benchmark, the null frequency bandwidth for the thinnest substrate simulated is less than 25 MHz. In contrast, for the thickest substrate simulated, the null frequency bandwidth is about 675 MHz, which corresponds to a fractional bandwidth relative to the center frequency of 13.5%.

One feature of the retro-reflective control elements of the present teaching is that they can be configured to provide retro-reflection control independent of the polarization of the incident radiation. This feature has important practical implications, since the state of polarization of the incoming radiation may be unknown and may also vary significantly over time. Consequently, in many practical applications of the present teaching, the retro-reflective control element will need to suppress the retro-reflection independent of the state of the incoming radiation.

Polarization independence of the retro-reflection control element of the present teaching to the incident radiation can be enhanced by using a retro-reflection control element comprising a circularly symmetric patch.

Figure 8:
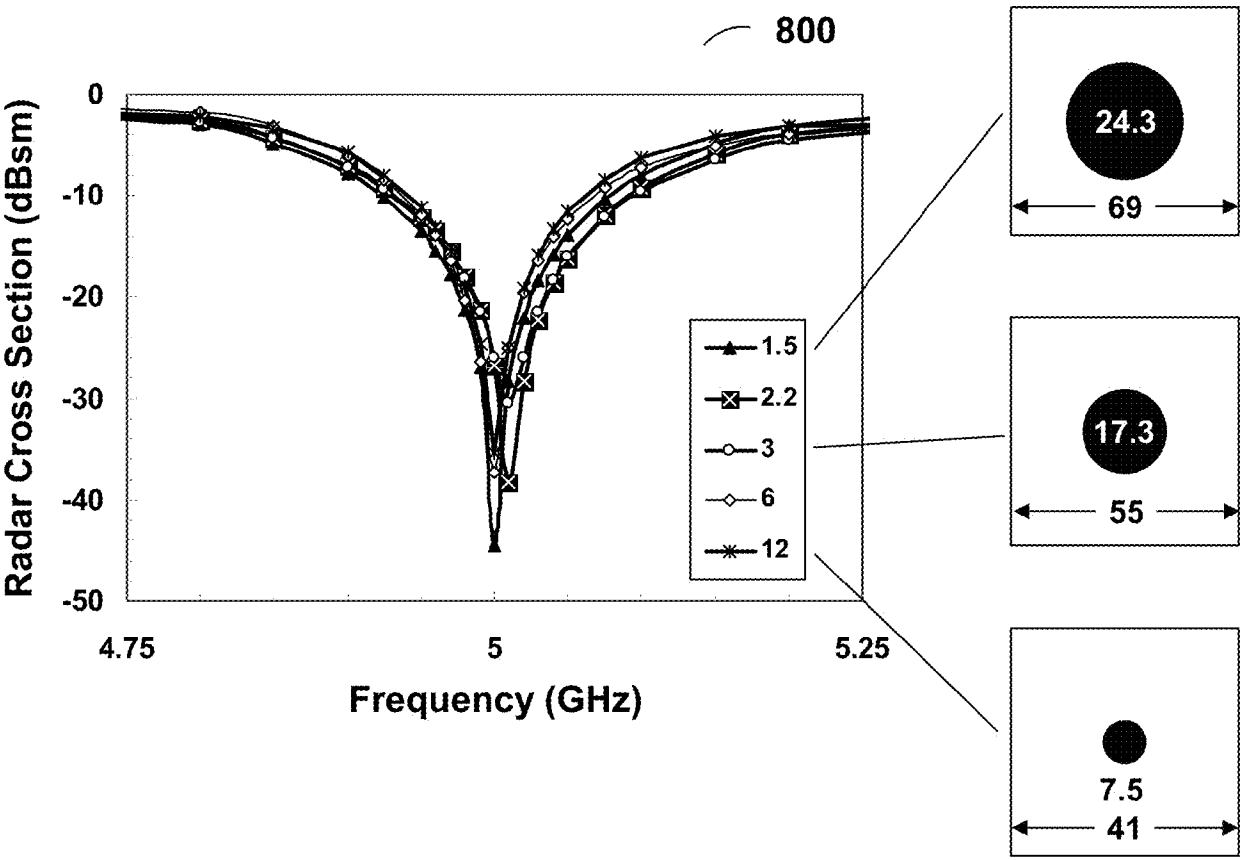
FIG. 8 presents simulation data of radar cross-section in dBsm of a retro-reflective control element, according to the present teaching, at broadside as a function of frequency for various substrate dielectric constants, k.

FIG. 8 presents simulation data 800 of radar cross-section in dBsm of a retro-reflective control element according to the present teaching at broadside as a function of frequency for various substrate dielectric constants, k. Independent of the dielectric constants, the simulation data are presented for bare metal plates of the same dimension as the substrate. The diameters of the circular conductive elements were scaled to keep the resonant frequency of the retro-reflection null at a constant frequency. The scaling also maintained a constant shadowing area as the diameter of the patch was changed. Data are presented for the following geometries: (1) a substrate with k=1.5, a 24.3 mm diameter circular conductive patch and a 69×69 mm substrate; (2) a substrate with k=2.2, a 20.2 mm diameter circular conductive patch and a 61×61 mm substrate; (3) a substrate with k=3, a 17.3 mm diameter circular conductive element, and a 55×55 mm substrate; (4) a substrate with k=6, a 11.8 mm diameter circular conductive element, and a 44×44 mm substrate; and (5) a substrate with k=12, a 7.5 mm diameter circular conductive element and a 41×41 mm substrate. The simulation data 800 presented in FIG. 8 indicate that the substrate dielectric constant has only minimal impact on either the depth or the bandwidth of the retro-reflection null.

Arrays of retro-reflection control elements spread across a surface of an object are used to control reflection of surfaces larger than a wavelength of the incident radiation, which is the case for most practical applications. A collection of retro-reflection control elements arranged on a regularly spaced 4×4 grid was simulated with a variable element spacing between the individual retro-reflection control elements. The minimum spacing simulated was one-half a wavelength. This minimum spacing is used because one-half a wavelength is the maximum spacing between antenna elements which will avoid grating lobs, which are unintended beams of radiation that occur in uniformly spaced antenna arrays (i.e. arrays with an equal distance between adjacent elements) when the antenna element separation is too large.

Figure 9:
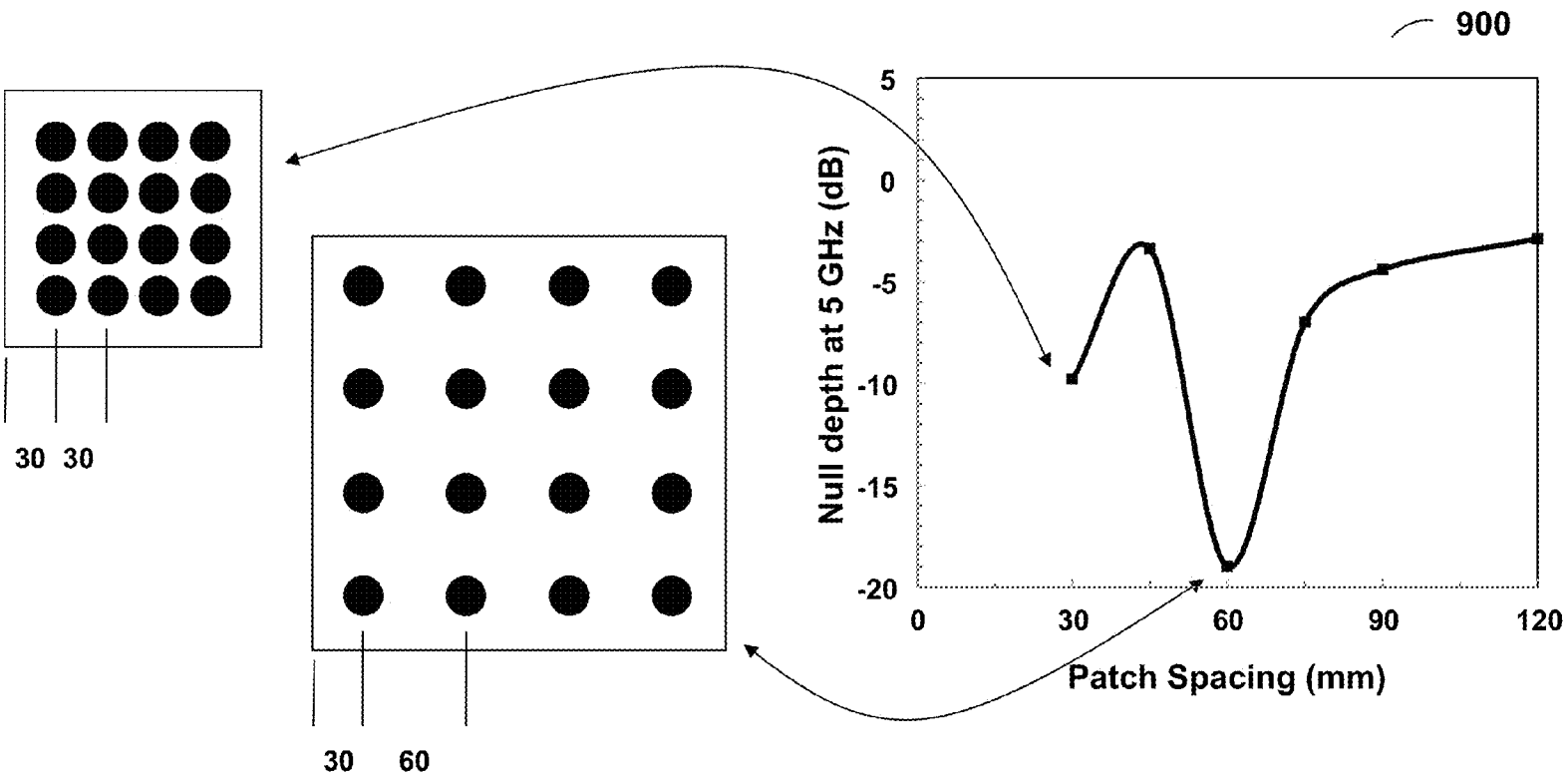
FIG. 9 is a plot of retro-reflection null depth at 5 GHz from a 4×4 arrangement of retro-reflecting control elements at broadside, as a function of patch spacing in mm.

FIG. 9 is a plot 900 of simulated maximum RCS suppression or null depth at 5 GHz measured at broadside in dB as a function of retro-reflection control element arrangement spacing in mm. The border around the array was held constant, to keep the shadow area of the surround constant. The simulations are for a dielectric substrate that is 3.175 mm thick having a dielectric constant is equal to 2.2 and a circular conductive patch element with a diameter that is 20.2 mm.

The simulation data indicate that over much of the reflection control element array spacing range, the null depths are similar to null depths simulated for individual isolated retro-reflection control elements. These results were unexpected because they suggest that each retro-reflecting control element in the 4×4 arrangement is acting essentially independently of its neighboring elements even though the element spacing would suggest that there would be some interaction. For this reason we are defining a group of reflection control elements as a retro-reflecting control element arrangement so that it is not confused with traditional antenna arrays.

The result that the retro-reflecting control elements in the 4×4 arrangement are acting essentially independently of their neighboring elements indicates that various arrangements of retro-reflecting control elements can be implemented without regard to regularity in arrangement element spacing. For example, two different arrangements of retro-reflecting control elements with different element spacing can be interleaved with each arrangement including the same or different diameter circularly symmetric patches. Using different diameter circularly symmetric patches is advantageous for some applications because the diameter of the circularly symmetric patches can be chosen so that the combined arrangement has a high degree of retro-reflection suppression over multiple frequency bands or one wide frequency band.

Figure 10B:
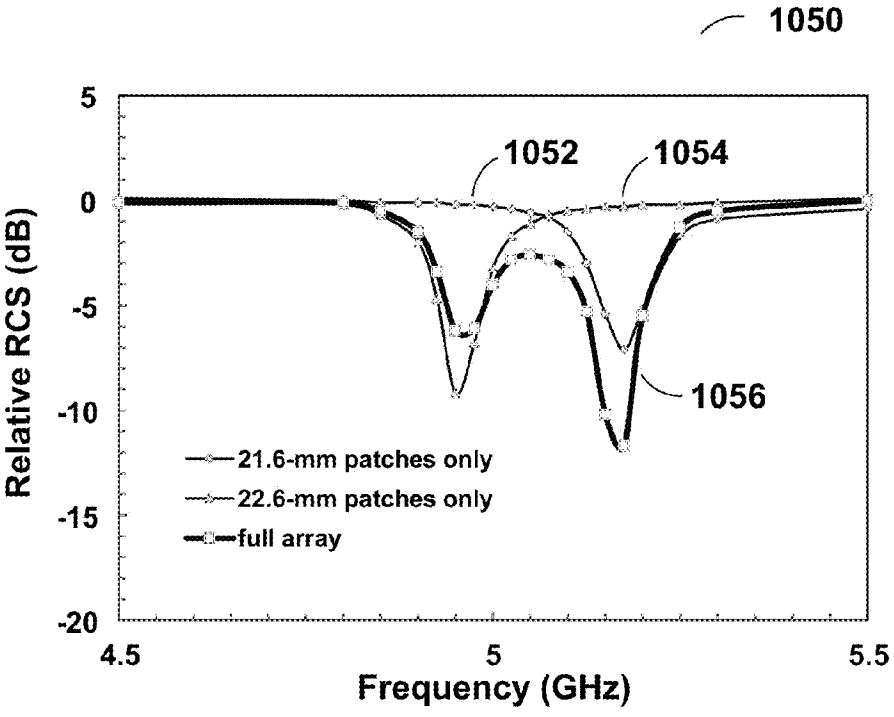
FIG. 10B is a plot of simulated relative radar cross section (RCS) in dB vs. frequency for the two arrangements of retro-reflecting control elements shown in FIG. 10A.
Figure 10A:
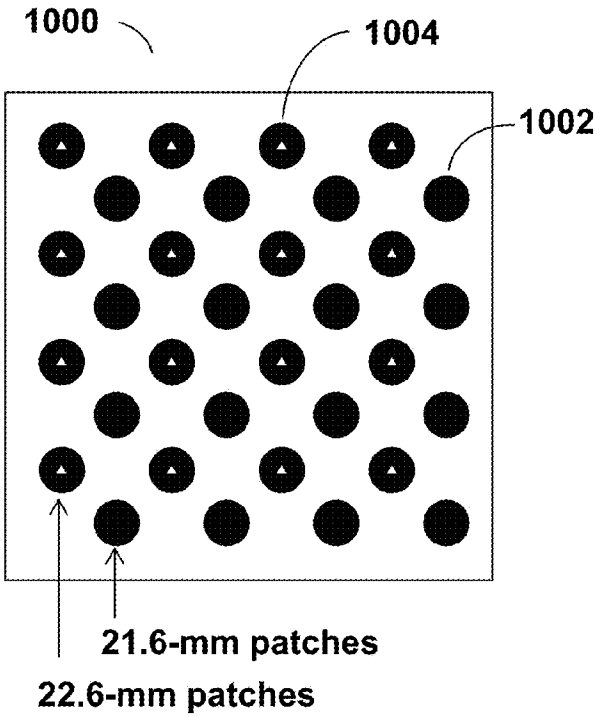
FIG. 10A illustrates two arrangements of retro-reflecting control elements with a, different diameter, circularly symmetric patch in each arrangement.

FIG. 10A illustrates two arrangements of retro-reflecting control elements, 1000, with different diameter circularly symmetric patches. One arrangement, 1002, has 21.6 mm diameter circularly symmetric patches. The other arrangement, 1004, has 22.6 mm diameter circularly symmetric patches.

FIG. 10B are plots 1050 of simulated relative radar cross section in dB for the two arrangements of retro-reflecting control elements shown in FIG. 10A. The first plot 1052 is the simulated relative radar cross section in dB for the first arrangement 1002 alone. The second plot 1054 is the simulated relative radar cross section in dB for the second arrangement of retro-reflecting control elements 1004 alone. As expected the center frequencies of the nulls are different for the two arrangements of retro-reflecting control elements because the circularly symmetric patch diameter are different for the two arrangements. The third plot 1056 is the simulated relative radar cross section in dB for the combined arrangement of retro-reflecting control elements which is the first and second arrangement interleaved. The third plot 1056 of the combined arrangement of retro-reflecting control elements is essentially the sum of the responses of the first and second arrangements of retro-reflecting control elements. Therefore, the simulations indicate that the two arrangements of retro-reflecting control elements are performing with a high degree of independence, which is different from what the known prior art would predict with such antenna geometries.

In other embodiments, multiple layers of conductive patch elements are used. Thus, the retro-reflecting control elements of the present teaching are not limited to planar conductive elements and not limited to any particular shape of conducting elements. Multiple layer conductive patch elements have the advantage that they can provide reflection control across a wide range of frequencies and/or a wide range of incident angles as compared to a single planar conductive patch. In addition, it has been determined that reflection control can be achieved across a wider range of frequencies and/or a wider range of incident angles by properly selecting the spacing between array elements.

As described in connection with FIG. 10, an overall arrangement that interleaves two sub-arrangements of conducting patches shows a surprising degree of independence between the two sub-arrangements. These data suggest that the RCS suppression response vs. frequency of the overall arrangement can be essentially the sum of the suppression responses of the two sub-arrangements taken individually for some geometries. It has been determined that the RCS suppression response vs. frequency of a vertical stack of two or more conducting patches is also the sum of the suppression responses of each of the patches, taken individually, which was also an unexpected result.

Figure 11A:
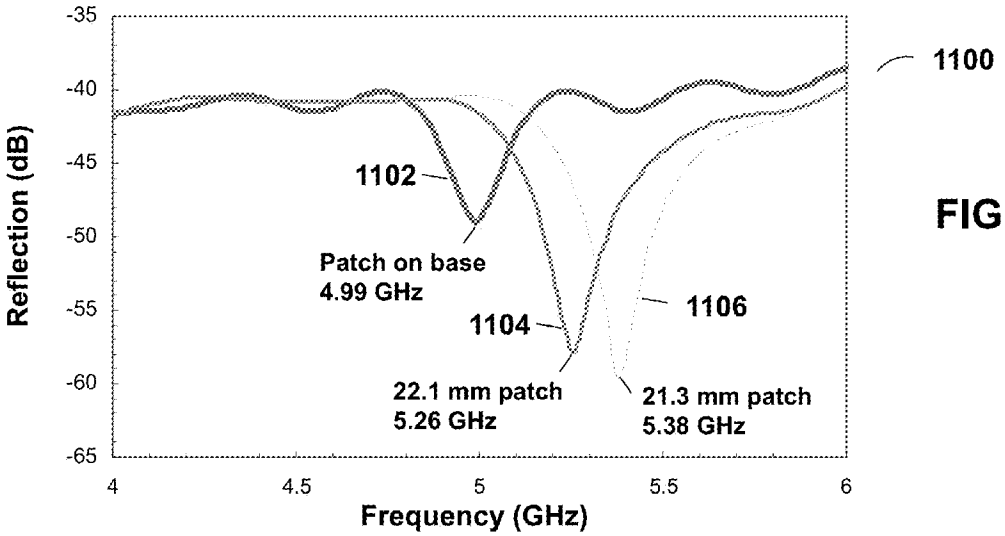
FIG. 11A illustrates three measurements of retro-reflection in dB, as a function of frequency, for three single retro-reflecting control elements, each with a different diameter, circularly symmetric conducing patch.

FIG. 11A illustrates reflection in dB as a function of frequency for three retro-reflecting control elements with different diameter circularly symmetric patches. The reflection vs. frequency of each of the conductive patches is measured individually and is shown in FIG. 11A, 1100. The reflection vs. frequency is dominated by a single suppression in reflection at the design frequency, which in this case is around 5 GHz. By comparing the frequency of the nulls in the three curves plotted in FIGS. 11A 1102, 1104, and 1106, the nulls occur at slightly different frequencies, which correspond to the slightly different patch diameters with the highest frequency null being caused by the smallest diameter patch.

Figure 11B:
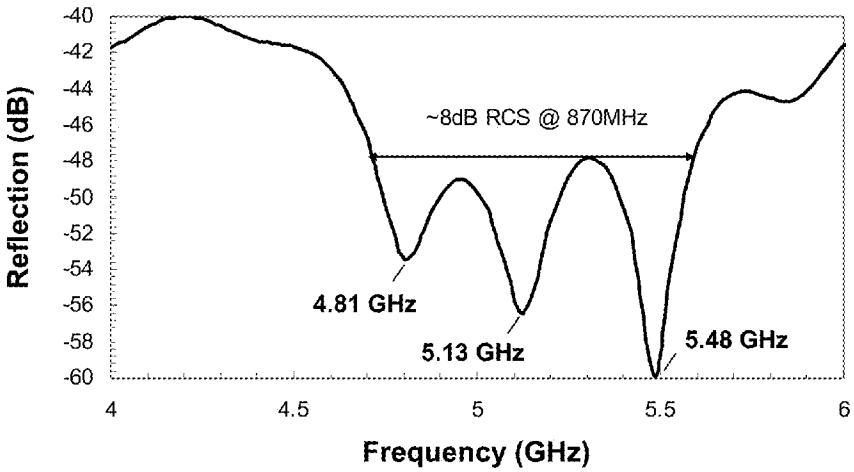
FIG. 11B illustrates a plot of measured retro-reflection in dB, as a function of frequency, for a single retro-reflection control element that consists of a vertical stack of the three patches as shown in FIG. 11A, with the smallest diameter patch on top, the intermediate diameter patch in the middle, and the largest diameter patch on the base plate.

FIG. 11B is a plot of measured reflection in dB with all three patched stacked vertically. For the measurement, the two conducting patches were stacked vertically on top of the patch on the base plate with the smallest diameter conductive patch positioned on top, the intermediate diameter patch in the middle and the largest diameter patch on the base plate. The reflection response vs. frequency was measured and is plotted in FIG. 11B, 1150. A qualitative comparison of the single curve 1150 shown in FIG. 11B reveals a striking similarity to the sum of the individual reflection curves that are plotted in FIGS. 11A, 1102, 1104, and 1106. This is indeed a surprising result considering that persons skilled in the art would expect similar results to what one would obtain when combining resonant electrical circuits where the loading among the individual resonant circuits would change the combined frequency response. For a more quantitative comparison, we compare the frequency of the nulls of the individual curves 1102, 1104 and 1106 of FIG. 11A with the corresponding frequencies of the nulls in the composite curve, 1150 of FIG. 11B. This comparison reveals that the maximum frequency shift in a null in the composite curve, relative to the frequency of the null in the corresponding individual curve ranges from −1.9% to 3.8%. These results show well formed nulls and a small shift in null frequency and, therefore, indicates that a high degree of independence exists among the three stacked patches.

EQUIVALENTS

While the applicants' teaching is described in conjunction with various embodiments, it is not intended that the applicants' teaching be limited to such embodiments. On the contrary, the applicants' teaching encompass various alternatives, modifications, and equivalents, as will be appreciated by those of skill in the art, which may be made therein without departing from the spirit and scope of the teaching.

What is claimed is:

1. A reflection controller for modifying electromagnetic reflections from a surface of a vehicle, the reflection controller comprising a retro-reflective control element being positioned proximate to an electromagnetically reflecting surface of the vehicle, the retro-reflective control element comprising a circularly-symmetric electrical conductor at a floating potential positioned on a dielectric substrate, wherein at least one of a dielectric thickness of the dielectric substrate, a dielectric constant of the dielectric substrate, or a diameter of the circularly-symmetric electrical conductor being chosen to reduce retro-reflection of incident radiation to the surface of the vehicle independent of a polarization of the incident radiation.

2. The reflection controller of claim 1, wherein the circularly-symmetric electrical conductor is planar.

3. The reflection controller of claim 1, wherein the retro-reflective control element comprises a plurality of stacked retro-reflective control elements.

4. The reflection controller of claim 3, wherein each of the plurality of stacked retro-reflective control elements comprises a circularly-symmetric electrical conductor with a different diameter.

5. The reflection controller of claim 3, wherein at least two of the plurality of stacked retro-reflective control elements comprises circularly-symmetric electrical conductor having a different diameter.

6. The reflection controller of claim 1, wherein the retro-reflective control element is displaced a predetermined distance from the electromagnetically reflecting surface of the vehicle.

7. The reflection controller of claim 1, wherein the vehicle is a ground vehicle.

8. The reflection controller of claim 1, wherein the vehicle is an aircraft.

9. The reflection controller of claim 1, wherein the vehicle is a ship.

10. A reflection controller for modifying electromagnetic reflections from a surface of a vehicle, the reflection controller comprising an arrangement of retro-reflective control elements at a floating potential and being positioned proximate to an electromagnetically reflecting surface of the vehicle, each of the retro-reflective control elements comprising a circularly-symmetric electrical conductor positioned on a dielectric substrate, wherein at least one of a dielectric thickness of the dielectric substrate, a dielectric constant of the dielectric substrate, or a diameter of the circularly-symmetric electrical conductor being chosen to reduce retro-reflection of incident radiation to the surface of the vehicle independent of a polarization of the incident radiation.

11. The reflection controller of claim 10, wherein a frequency response of at least some of the retro-reflective control elements in the arrangement of retro-reflective control elements is effectively independent of the frequency response of at least one of another arrangement of retro-reflective control elements.

12. The reflection controller of claim 10, wherein a frequency response of at least some of the retro-reflective control elements in the arrangement of retro-reflective control elements overlaps with the frequency response of at least one of another arrangement of retro-reflective control elements.

13. The reflection controller of claim 10, wherein at least two of the circularly symmetric electrical conductors have different diameters.

14. The reflection controller of claim 10, wherein at least one of the circularly-symmetric electrical conductors in the arrangement is planar.

15. The reflection controller of claim 10, wherein at least one of the arrangements of retro-reflective control elements comprises a plurality of stacked circularly-symmetric electrical conductors.

16. The reflection controller of claim 15, wherein each of the plurality of stacked circularly-symmetric electrical conductors has the same diameter.

17. The reflection controller of claim 15, wherein at least two of the plurality of stacked circularly-symmetric electrical conductors have a different diameter.

18. The reflection controller of claim 10, wherein the arrangement is displaced a predetermined distance from the surface of the vehicle.

19. The reflection controller of claim 10, wherein the vehicle comprises a ground vehicle.

20. The reflection controller of claim 10, wherein the vehicle comprises an aircraft.

21. The reflection controller of claim 10, wherein the vehicle comprises a ship.

22. The reflection controller of claim 1, wherein the circularly-symmetric electrical conductor is non-planar.

23. The reflection controller of claim 10, wherein at least one of the circularly-symmetric electrical conductor in the arrangement is non-planar.

24. The reflection controller of claim 1 wherein the dielectric substrate is positioned on a base plate.

25. The reflection controller of claim 10 wherein the dielectric substrate is positioned on a base plate.

* * * * *